United States Patent [19]

Gassner et al.

[11] 3,942,313

[45] Mar. 9, 1976

[54] FALSE TWISTER

[75] Inventors: Hans Gassner, Schweinfurt; Max Thielemann; Friedrich Schuster, both of Hammelburg, all of Germany

[73] Assignee: Kugelfischer Georg Schafer & Co., Schweinfurt, Germany

[22] Filed: Jan. 10, 1975

[21] Appl. No.: 540,221

[30] Foreign Application Priority Data

Jan. 15, 1974 Germany ..... 2401776

[52] U.S. Cl. ..... 57/77.4

[51] Int. Cl.[2] ..... D02G 1/08

[58] Field of Search ..... 57/77.3–77.45, 57/106, 34 R

[56] References Cited

UNITED STATES PATENTS

| | | | |
|---|---|---|---|
| 3,287,890 | 11/1966 | McIntosh et al. | 57/77.4 |
| 3,762,149 | 10/1973 | Raschle | 57/77.4 |
| 3,820,317 | 6/1974 | Raschle | 57/77.4 |
| 3,828,541 | 8/1974 | Raschle | 57/77.4 X |
| 3,872,661 | 3/1975 | Spencer | 57/77.4 |

FOREIGN PATENTS OR APPLICATIONS

| | | | |
|---|---|---|---|
| 1,254,093 | 1/1961 | France | 57/77.4 |

*Primary Examiner*—Donald E. Watkins
*Attorney, Agent, or Firm*—Stevens, Davis, Miller & Mosher

[57] ABSTRACT

A false twisting apparatus having three spindles supporting over-lapping friction discs and having a means for feeding a thread between the friction discs where it will be false twisted and into a balloon preventing member is provided with an improved means for threading the apparatus by moving a thread into position between the friction disc comprising a thread guide member on an arm supported by a rotatable shaft with the guide member above the friction disc, the rotatable shaft being rotatable from a position where the guide member is disposed above the gap between the edges of the friction disc to where the guide member is disposed outside the friction disc and a thread slide member supported on a shaft and projecting inwardly between longitudially spaced friction discs, the slide member having arcuate shaped edges over which the thread can slide as it is moved by the thread guide member into or out of the gap between the friction members.

13 Claims, 4 Drawing Figures

FALSE TWISTER

This invention relates to apparatus for false-twisting a thread and more particularly to such an apparatus having an improved thread feeding means.

An apparatus for false-twisting threads by means of friction elements, in particular for crimping synthetic threads, comprising three rotatably mounted spindles each provided with at least one rotationally symmetrical friction element, which spindles form, in plan view, the corners of an equilateral triangle and are each adjustable, the thread to be false-twisted passing between the friction elements in a zig-zag path, to provide for common adjustability of the spindles with respect to the path of the thread in such a way that in each position of adjustment the spindles lie at the corners of an equilateral triangle in plan view, the path of the thread lying at the middle of the triangle is disclosed in German OS No. 2,213,147 and U.S. Pat. application Ser. No. 342,085 filed Mar. 16, 1973.

In a further development of this known apparatus, in particular with a view to facilitating threading up the thread or yarn which is to be false-twisted, it has already been proposed to provide a hollow angularly movable mandrel, co-axial with the path of the thread, with an eccentric which projects between the spindles and has three profile cam surfaces, against each of which an associated housing of a respective spindle is resiliently urged, the eccentric being movable between an open position, in which the friction elements on the spindles leave free an axial clearance passage for the thread, and a closed position, in which the friction elements overlap one another.

As a rule the friction elements are circular discs. The three spindles are coupled together so that they always rotate in the same direction. In order to impart to the thread, which always passes through the apparatus in the same direction, for example downwards, an S twist or a Z twist, the direction of rotation of the spindles is set correspondingly to be clockwise or counter-clockwise, the friction elements being arranged so that, as the thread passes between the friction elements they act on it not only to provide a twisting force component but also a component acting in the direction of travel of the thread in order to transport the thread.

False twisters with three rotatably mounted spindles, each provided with at least one rotationally symmetrical friction element, which spindles are arranged at a fixed mutual spacing so that in plan view they lie at the corners of an equilateral triangle, do not, it is true, provide the advantage of optimum adjustment of the spindles but they are cheaper to manufacture. Once the optimum setting has been obtained and the spindles have been clamped in place on the appropriately constructed base plate, this optimum adjustment is maintained. Moreover, repeatable settings from one spinning frame to another or from one false-twisting frame to another are obtainable with regard to the height tolerances.

It is an object of this invention to provide apparatus of the kind described above which allows simple threading-up of the thread which is to be false-twisted. Still another object of the invention is to provide a false-twisting apparatus of the type described above with an improved thread guiding means.

Other objects will become apparent from the following description with reference to the accompanying drawing wherein FIG. 1 is a diagrammatic plan view of one embodiment of the apparatus provided by the invention;

Figure 1:
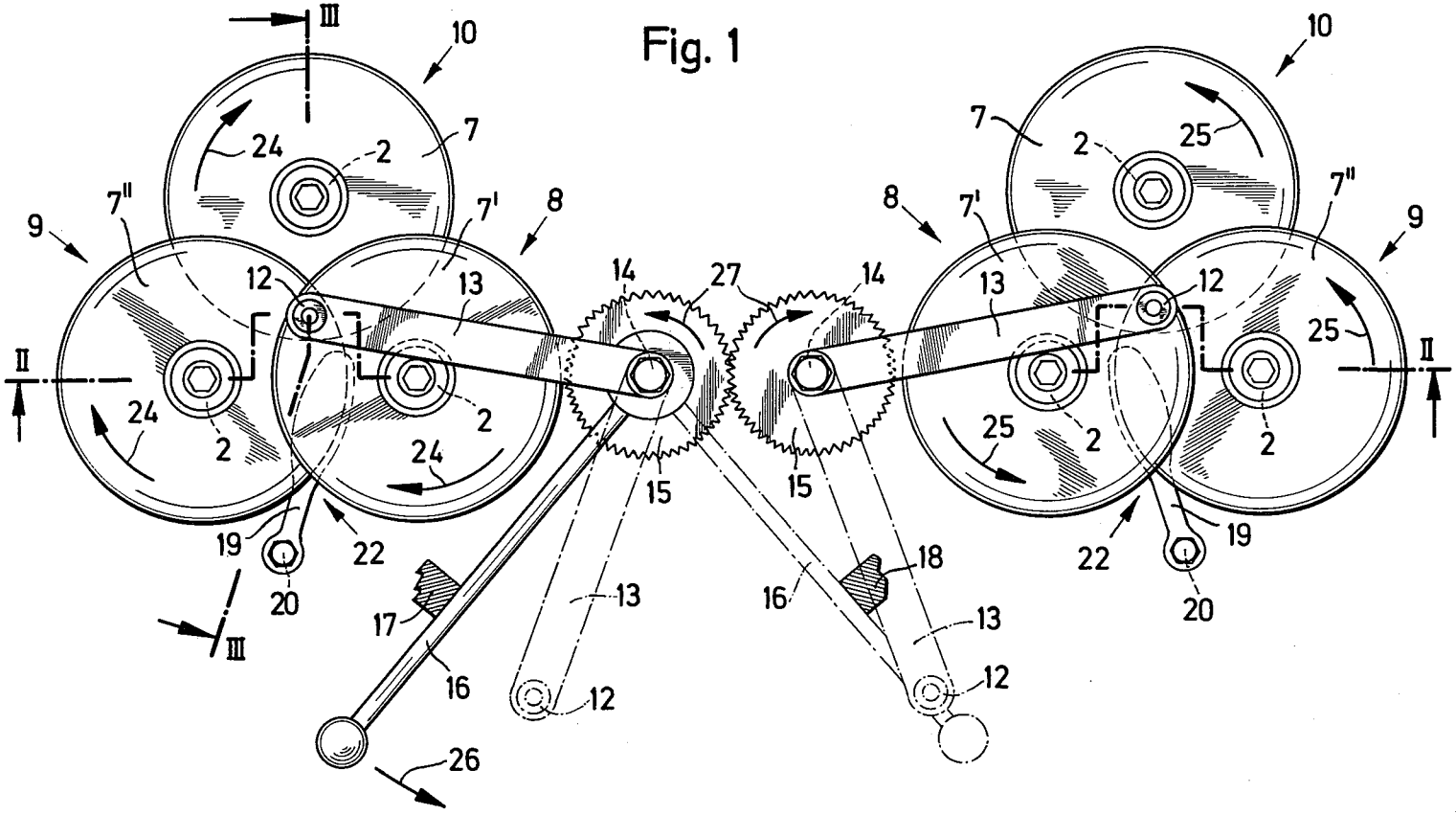

The foregoing objects and others are accomplished in accordance with this invention, generally speaking, by providing a false-twisting apparatus of the type described above with at least one thread guide which is displaceable between a diverted position in which the thread runs clear of the friction discs and a false-twisting position in which the thread runs between the discs in a zig-zag path.

The provision of one or more displaceable thread guides not only allows the apparatus to be threaded up but also allows the thread to be taken out of the apparatus when the spindles are running, which may be advantageous in false twisting in many cases. Particularly favorable is such a thread guide arrangement in which the thread, on displacement from the diverted position into the false-twisting position, comes into engagement with that region of the disc at the entry and (i.e., the disc first encountered by the thread at the entry end of the apparatus) in which the disc is moving towards the center of the apparatus. The entry-end disc is preferably driven in such a direction of rotation that, in the region overlapping the next friction disc on a different spindle, its peripheral edge is moving towards the center of the apparatus, and the thread, on displacement of the thread guide from the diverted position to the false-twisting position, passes into that wedge-shapped gap which the entry-end disc forms with the next disc.

An additional thread guide can be provided, which is displaceable together with the first thread guide. While the first thread guide is provided at the thread entry-end of the apparatus, the second thread guide is provided at the exit end.

Also a tandem arrangement of two false twisters each with a displaceable thread guide is advantageous in a form in which the thread guides of the two twisters are coupled together and displaceable simultaneously. Then only the thread guide or pair of guides of one twister needs to be actuated, and the guide or pair of guides of the other twister follows its movement automatically.

Particularly advantageous is the combination of a displaceable thread guide or pair of guides with fixed thread guiding tongues which are placed at the levels of the third, and sixth friction discs and so on and have a portion provided with a contoured edge projecting into the region of the periphery of the second and fifth friction discs and so on, each tongue being placed at the portion of the periphery past which the thread moves on displacement of the thread guide. The thread guiding tongues not only act so that, on threading-up into the apparatus and preferably on removal from it, the thread is guiding past the regions of the peripheries of the second and fifth discs and so on, which are moving away from the center of the apparatus, but also achieves the result of a minimum rotation of the thread on entry, so that the danger of breakage of the thread is reduced. In particular the thread guiding tongues act in this regard on false-twisting of threads of low denier and/or is of particular advantage when the friction discs have a relatively sharp-edged profile.

The first disc, i.e., the entry-end disc, and the fourth disc and so on are mounted on a first spindle, while the second, fifth and so on discs are mounted on a second spindle and the third, sixth and so on discs finally are mounted on the third spindle.

Displaceable thread guides in apparatus for friction false-twisting threads are known in themselves. The thread guides serve to urge the thread to be false-twisted into the wedge-shaped gap between two sets of mutually overlapping friction discs, to bring the thread against these discs and allow it to run against them. The sets of friction discs are mounted on two mutually parallel axes. According to one known proposal of this kind, a tandem arrangement of two such sets of friction discs is provided in such a way that the two thread guides of each set are actuated simultaneously (German OS No. 1,510,770). In another proposal of this kind, there are two pairs of thread guides, which are pivoted simultaneously and serve solely for guiding the thread in the diverted position. When they are swung away from this position they leave the thread free (German OS No. 2,220,375).

A preferred embodiment of the false twister according to the invention in a tandem arrangement is described by way of example with reference to the accompanying drawing.

Figure 2:
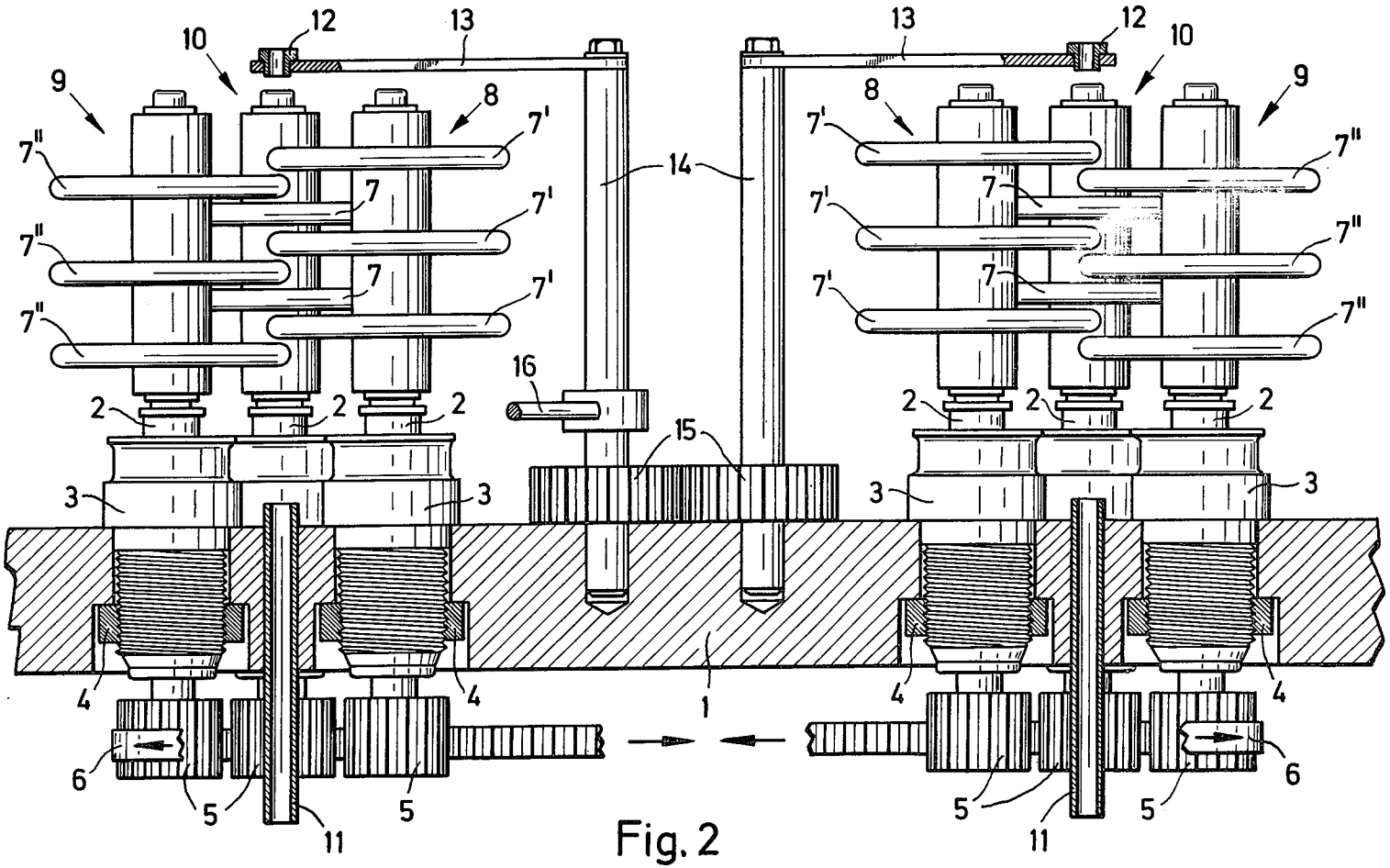
FIG. 2 is a section taken along the line II—II of FIG. 1.

Referring to FIGS. 1 and 2, two false-twister apparatus assemblies are provided on a common base plate 1. Each apparatus has three spindles 2 which, in plan view, lie at the corners of an equilateral triangle. Each spindle 2 is provided with a sealed bearing 3 secured to the base plate 1 by means of a nut 4. At the lower end as viewed in FIG. 2 each spindle is furthermore provided with an externally toothed wheel 5. All three wheels 5 of each false twister are enclosed by a common internally toothed belt 6.

On each spindle 2 there is secured a set of friction discs 7. The discs 7 on each spindle 2 overlap the discs 7 on the other two spindles 2 of each false twister. While the two sets 8 and 9 which are in front in FIG. 2 in each of the two false twisters have three discs 7 on them, the rear set 10 may have only two discs 7.

Each of the two false twisters is provided with a stationary tubular balloon-preventer 11 which, in the case illustrated, lies at the center of the above-mentioned triangle of spindles and passes through the base plate 1. Furthermore, each false twister has associated with it a movable thread guide member 12, at the opposite face of the discs 7 from the balloon-preventer 11.

The thread guide member 12 is provided on an arm 13 on a shaft 14 which is parallel to the spindles 2 and which is rotatably mounted in the base plate 1 at that end which is farthest from the arm 13. A pinion 15 is mounted on each shaft 14. The two pinions 15 mesh with one another.

On the left hand shaft 14 as viewed in FIGS. 1 and 2 there is also mounted an actuating lever 16 which can pivot between two stops 17 and 18, as shown in FIG. 1.

Figure 4:
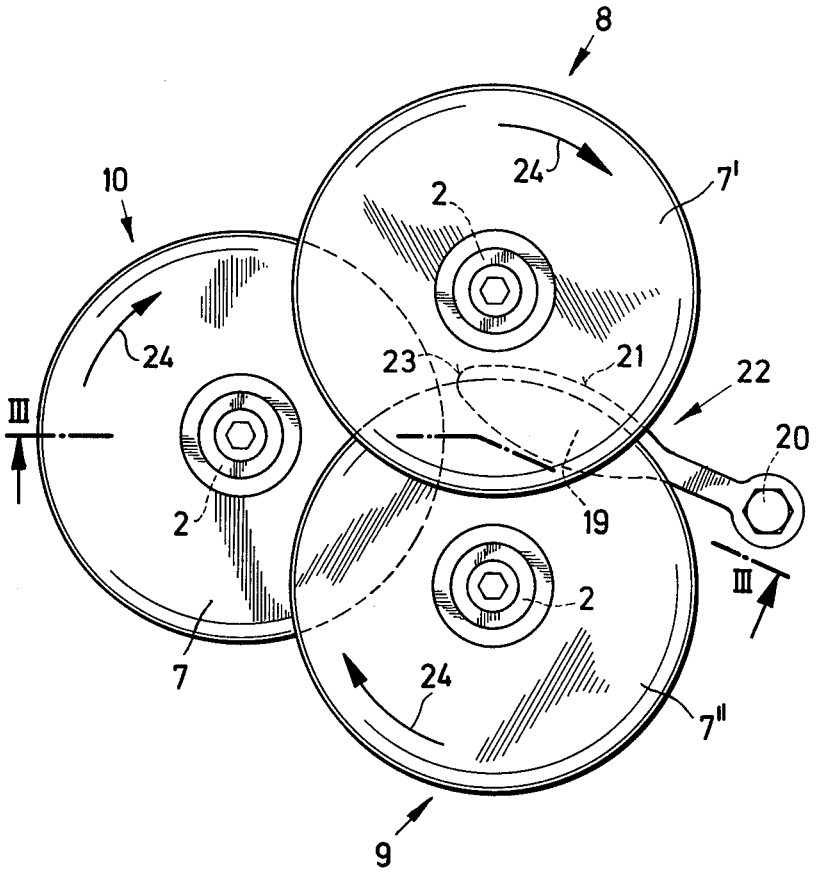
FIG. 4 is a diagrammatic plan view of the set of friction discs shown in FIG. 3 showing thread guiding tongues; these tongues being omitted from the remaining Figures in the interest of greater clarity.

Referring to FIG. 4, each of the two false twisters has a stationary thread guiding tongue 19 associated with it, for example made of sheet metal. The tongues 19 of each false twister are secured to a common post 20 parallel to the spindles 2, and lie one above the other so that in the plan view shown in FIG. 4 only the uppermost tongue 19 is visible insofar as it is not hidden by the discs 7. This hidden part is indicated in broken lines in FIG. 4.

Figure 3:
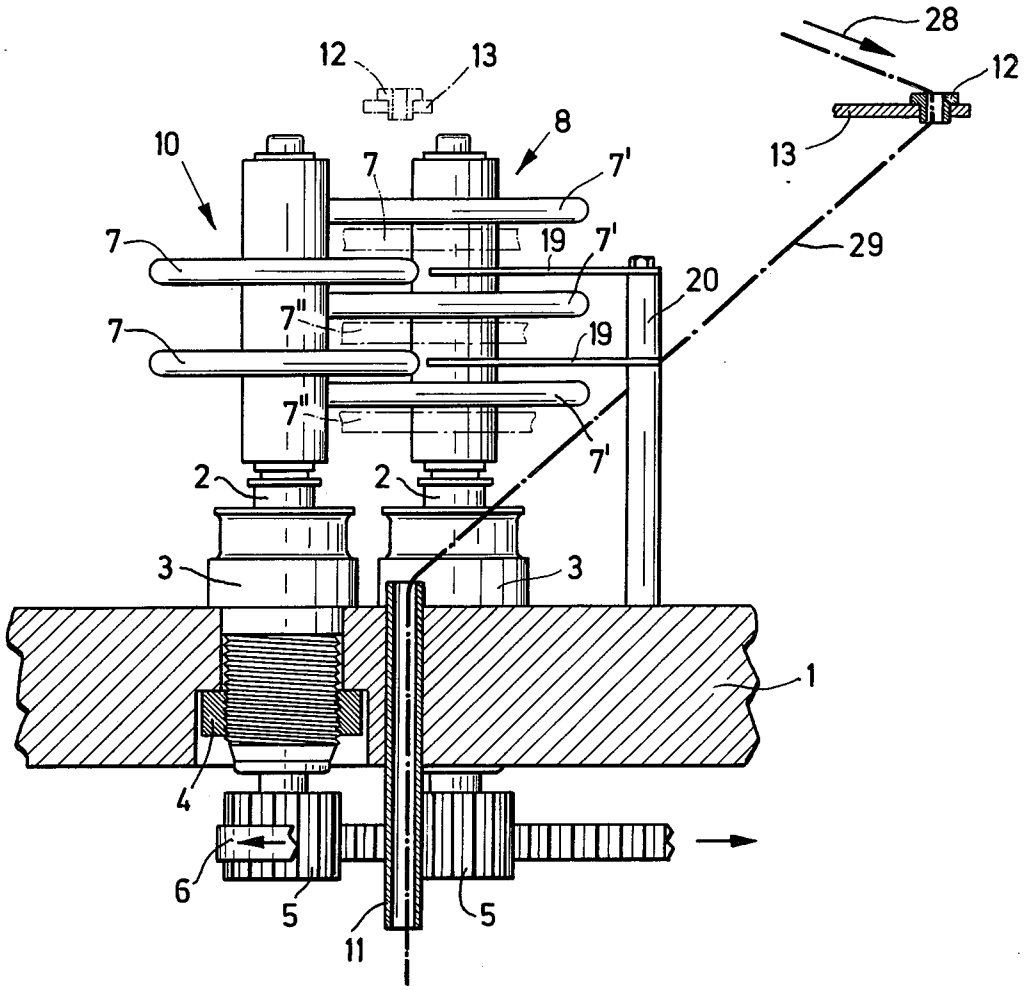
FIG. 3 is a section taken along the line III—III of FIG. 1.

On each post 20 the thread guiding tongues 19 are each secured at the level of the third and sixth disc 7 counting from the top downwards in FIGS. 2 and 3, these discs being on the rear or left hand spindle 2 of the associated false twister. A third tongue 19 is provided below the lowest disc 7 on that spindle 2 which carries the second and fifth disc 7 and so on. If this is missing then also the third thread guiding tongue 19 can be omitted.

As shown in FIG. 4 the thread guiding tongues 19 have a contoured portion 21 which extends into the region of the periphery of the respective disc 7 which lies directly above, and in fact the region of that portion of the periphery over which the thread which is to be false-twisted passes on displacement of the thread guide member 12. The profiled edge of the portion 21 therefore runs from that wedge-shaped gap 22 between the sets of friction discs 8 and 9 into which the thread passes on displacement of the thread guide member 12 from the diverted position to the false-twisting position, towards the center of the apparatus, that is to say the center of the triangle of spindles, following the periphery of the disc 7 which is directly above, as shown in FIG. 4. The profiled edge or contoured portion 21 is in the shape of an arc of a circle with a radius of curvature substantially equal to the radius of the discs 7. Likewise, the opposing edge of each tongue 19 is shaped correspondingly. The two mutually opposite edges meet at a rounded portion 23 at the end which is farthest from the post 20. Each tongue 19 is accordingly symmetrical with respect to its longitudinal axis.

In operation the sets 8, 9 and 10 of friction discs of each false twister rotate in the same direction as indicated by the arrows 24 and 25 in FIGS. 1 and 4. Assuming the thread passes through each false twister in a downward direction then in the left hand apparatus as viewed in FIG. 1, it receives an S twist and in the right hand apparatus it receives a Z twist. However, the two false twisters could also be made identical with regard to the arrangement of the sets of friction discs 8, 9 and 10 so that the thread which passes through each of the two twisters receives an S twist or a Z twist.

What is important is simply that the wedge-shaped thread entry gap 22 in each false twister is formed by the two sets of friction discs 8 and 9 with the first disc 7' at the entry-end and the following second disc 7'', the set of discs on the spindle designated 8 in FIG. 2 which includes friction disc 7' rotating in such a direction of rotation that the periphery of the discs in the region where they overlap the set 9 is moving from the gap 22 towards the center of the apparatus, that is to say, towards the center of the above-mentioned triangle of spindles. This favors a gentle and satisfactory thread entry, the thread guiding tongues 19 preventing possible damage by the discs of the set 9 of which the peripheries are moving from an inward to an outward direction.

In FIG. 1 the thread guide member 12 and the operating lever 16 are shown in the false-twisting position in full lines, which is also illustrated in FIG. 2. The two threads, now shown, each pass through the associated thread guide member 12 and then along a zig-zag path through the associated sets 8, 9 and 10 of friction discs and through the balloon-preventer 11, which is aligned with the thread guide member 12, and then out of the false twister.

In FIG. 1 the operating lever 16 lies against the stop 17 which is provided, for example, on the base plate 1. By movement of the lever 16 in the direction of the arrow 26 until it engages the second stop 18, likewise provided, for example, on the base plate 1, the two threads are guided out of the two false twisters, so that they engage the edges of the contoured portions 21 of the respective thread guiding tongue 19 and slide over them. The diverted position of the two thread guides 12, shown in broken lines in FIG. 1, is ultimately reached. While the left hand thread guide member 12 in FIGS. 1 and 2 is pivoted directly by the operating lever 16 the right hand guide member 12 is taken with it by means of the meshing pinions 15, which turn in the direction of the arrows 27.

As shown in FIG. 3, in the diverted position of the thread guide 12, the associated thread 29, moving in the direction of the arrow 28, runs clear of the associated sets of friction discs 8, 9 and 10. When the operating lever 16 is now moved from the position shown in broken lines in FIG. 1, against the direction of the arrow 26, into the position shown in full lines to come into engagement with the stop 17, then the two thread guides move likewise together from the diverted position shown in broken lines into the false-twisting position shown in full lines, the respective thread 29 moving into the associated gap 22 and sliding along the edge of the contoured portion 21 of the respective tongue 19, in order finally to run in the middle of the respective apparatus or triangle of spindles in a zig-zag path past the associated sets 8, 9 and 10 of friction discs.

In FIG. 3, the discs 7 of the set 9 are shown in broken lines, as is the thread guide 12 of the apparatus illustrated in the false-twisting position.

Although the invention has been described in detail for the purpose of illustration, it is to be understood that such detail is solely for that purpose and that variations can be made therein by those skilled in the art without departing from the spirit and scope of the invention except as it may be limited by the claims.

We claim:

1. In an apparatus for false twisting threads by means of friction discs which comprises three rotatably mounted spindles, each provided with at least one friction disc, the spindles lying at the corners of an equilateral triangle in plan view and being arranged at a fixed mutual spacing and driven in the same direction of rotation, the friction discs on each spindle overlapping the discs on the two other spindles and means for passing the thread which is to be provided with a false twist through at least one thread guide, a thread guide which is movable between a diverted position in which the thread runs clear of the friction discs and a false-twisting position in which it runs between the discs in a zig-zag path.

2. The apparatus of claim 1 wherein the thread guide is arranged whereby the thread, on displacement from the diverted position to the false-twisting position, comes into engagement with that region of the first friction disc at the entry-end of the thread in which the said first friction disc is moving towards the center of the triangle of spindles.

3. The apparatus of claim 1 wherein there is provided a stationary thread guiding tongue for the or each disc the periphery of which moves in use from an inward to an outward direction in that region of the periphery along which the thread is moving on displacement of the thread guide, said tongue being positioned at the level of the following disc as viewed from the thread entry-end and having a contoured portion which extends into the said region of the periphery of the associated disc for slidingly supporting the thread on said displacement of the thread guide.

4. The apparatus of claim 3 wherein the thread guiding tongues have a contoured portion having edges which are arcs of circles with a radius of curvature substantially equal to the radius of the friction discs.

5. The apparatus of claim 3 wherein the thread engages the contoured portion of the tongues both on displacement of the thread guide from the diverted position into the false-twisting position and also on movement in the opposite direction.

6. The apparatus of claim 3 wherein each thread guiding tongue has a shape which is symmetrical with respect to its longitudinal axes.

7. The apparatus of claim 3 wherein the thread guiding tongues are secured on a post which is parallel to the spindles.

8. The apparatus of claim 1 wherein a pair of thread guide members are provided and both thread guide members are displaceable together.

9. The apparatus of claim 1 wherein at least one of the thread guide members is provided with an arm pivotably disposed on a shaft about and parallel to the spindles between two end positions.

10. The apparatus of claim 9 wherein the shaft has an operating lever which can swing between the two end positions.

11. A tandem arrangement of two sets of the apparatus of claim 1 having thread guides which are coupled together and are displaceable simultaneously.

12. The tandem arrangement of claim 11 wherein each thread guiding means comprises a shaft having a longitudinal axis parallel to the longitudinal axes of the spindles and pivotable between two positions where the thread is guided between the friction discs and where the thread is removed from between the friction discs, said shafts being geared together, and an arm disposed above the first friction disc carrying a thread guiding member fixed to each of said shafts.

13. In a false-twisting apparatus comprising spindles having overlapping friction discs disposed where a thread passing therebetween will pass over the edges thereof and means for guiding a thread between the said discs and into a balloon preventer, a thread feeding means for moving a thread into and out of a position where it is false twisted comprising a thread guide member, an arm supporting said guide member and a rotatable shaft supporting said arm with the guide member above the top friction disc, said rotatable shaft being rotatable from a position where the guide member is disposed above the gap between the edges of the friction discs to where the guide member is disposed outside said friction discs, and a thread slide member supported between a pair of longitudinally spaced friction discs and having opposite arcuate shaped edges over which the thread slides as the thread guide member moves the thread into and out of said gap.

* * * * *